US009920549B2

(12) United States Patent
Little et al.

(10) Patent No.: US 9,920,549 B2
(45) Date of Patent: Mar. 20, 2018

(54) COMBINATION PADLOCK

(71) Applicant: DG INTERNATIONAL HOLDINGS LTD, London (GB)

(72) Inventors: Simon Little, London (GB); Karl Lai, Hong Kong (CN)

(73) Assignee: DG INTERNATIONAL HOLDINGS LIMITED (GB)

( * ) Notice: Subject to any disclaimer, the term of this patent is extended or adjusted under 35 U.S.C. 154(b) by 0 days.

(21) Appl. No.: 15/544,551

(22) PCT Filed: Jan. 18, 2016

(86) PCT No.: PCT/GB2016/050096
§ 371 (c)(1),
(2) Date: Jul. 19, 2017

(87) PCT Pub. No.: WO2016/116735
PCT Pub. Date: Jul. 28, 2016

(65) Prior Publication Data

US 2018/0016813 A1 Jan. 18, 2018

(30) Foreign Application Priority Data

Jan. 19, 2015 (GB) ..... 1500848.5

(51) Int. Cl.
*E05B 37/02* (2006.01)
*E05B 37/00* (2006.01)
(Continued)

(52) U.S. Cl.
CPC ..... *E05B 37/0068* (2013.01); *E05B 37/0034* (2013.01); *E05B 37/0058* (2013.01);
(Continued)

(58) Field of Classification Search
CPC .... E05B 37/0068; E05B 37/02; E05B 37/025; E05B 67/00; E05B 67/02
See application file for complete search history.

(56) References Cited

U.S. PATENT DOCUMENTS 2,546,182 A 3/1951 Fenari
3,837,189 A 9/1974 Atkinson
(Continued)

FOREIGN PATENT DOCUMENTS

| | | |
|---|---|---|
| EP | 1688567 | 9/2006 |
| GB | 2493266 | 1/2013 |
| WO | 9111580 | 8/1991 |

OTHER PUBLICATIONS

Search Report dated May 15, 2015 in priority Great Britain patent application GB1500848.5.
(Continued)

*Primary Examiner* — Christopher J Boswell
(74) *Attorney, Agent, or Firm* — Andrus Intellectual Property Law, LLP

(57) ABSTRACT

Some designs of combination padlock allow users of the padlocks to set the combinations that unlock the padlocks. However, the operations which a user must perform to set the combination of a padlock typically involve manipulating the shank of the padlock by pulling the shank away from the housing of the padlock or pushing part of the shank further into the housing of the padlock, rotating the shank through a certain angle, and holding or fixing the shank in this position while rotating dials of the padlock to change the combination. Such operations are fiddly, and it can be difficult to remember what steps are required to change the combination. Thus there is provided a combination padlock which goes some way towards overcoming or at least ameliorating one or more of the above problems.

20 Claims, 6 Drawing Sheets

(51) Int. Cl.
*E05B 67/02* (2006.01)
*E05B 67/00* (2006.01)

(52) U.S. Cl.
CPC ..... *E05B 37/025* (2013.01); *E05B 67/00* (2013.01); *E05B 67/02* (2013.01)

(56) References Cited

U.S. PATENT DOCUMENTS 4,763,496 A * 8/1988 Evans ..... E05B 67/24 70/368
4,887,441 A * 12/1989 Ling ..... E05B 37/025 70/25
5,970,755 A 10/1999 Appelbaum
6,363,758 B1 4/2002 Ling
6,386,005 B1 5/2002 Kuo
6,393,876 B1 * 5/2002 Matyko ..... E05B 67/02 70/38 A
7,210,318 B2 * 5/2007 Yu ..... E05B 35/105 70/21
7,213,425 B2 * 5/2007 Ling ..... E05B 37/0034 70/21
8,171,760 B2 * 5/2012 Yen ..... E05B 35/105 70/21
8,261,583 B2 * 9/2012 Lai ..... E05B 35/105 70/21
8,353,186 B2 * 1/2013 Schaefer ..... B62H 5/18 70/20
9,464,460 B2 * 10/2016 Lai ..... E05B 37/14
9,556,650 B1 * 1/2017 Lai ..... E05B 37/025
2006/0027001 A1 2/2006 Lai
2010/0095718 A1 4/2010 Lai et al.
2016/0258187 A1 * 9/2016 Little ..... E05B 35/105
2017/0138089 A1 * 5/2017 Yang ..... E05B 37/0055

OTHER PUBLICATIONS

PCT International Search Report and Written Opinion dated Apr. 29, 2016 in parent PCT application PCT/GB2016/050096.

* cited by examiner

COMBINATION PADLOCK

CROSS REFERENCE TO RELATED APPLICATIONS

The present application is the U.S. national stage application of International Application PCT/GB2016/050096, filed Jan. 18, 2016, which international application was published on Jul. 28, 2016 as International Publication WO 2016/116735 A1. The International Application claims priority to Great Britain Patent Application 1500848.5 filed Jan. 19, 2015.

This invention relates to a combination padlock. In particular, it relates to features of a combination padlock which are involved in setting the combination for the padlock.

BACKGROUND OF THE INVENTION

Combination padlocks typically include a housing part and a padlock shank or shackle. The shank is usually approximately 'U'-shaped, and the housing part is arranged such that it can receive and retain the ends of the shank in recesses of the housing part.

The housing part houses a combination locking assembly which is operable between a locked configuration and an unlocked configuration. The combination locking assembly includes several dials which are provided with numbers, letters or other characters. The dials can be rotated and aligned with one another and with a feature of the housing part. When an incorrect combination of characters is aligned with the feature of the housing part, the combination locking assembly will be in the locked combination. When the correct combination of characters is aligned with the feature of the housing part, the combination locking assembly will be in the unlocked configuration.

When the combination locking assembly is in the locked configuration, the ends of the shank are held in the recesses of the housing part, such that neither end of the shank can be withdrawn from the corresponding recess. When the combination locking assembly is in the unlocked configuration, the shank can be moved a first distance away from the housing part, such that a first end of the shank is withdrawn from its corresponding recess in the housing part. When the first end of the shank has been withdrawn from its corresponding recess, the shank can be rotated relative to the housing part about the shank's second end, the second end of the shank still being held within its corresponding recess in the housing part.

If a user of the combination padlock wishes to change the combination of characters which unlocks the combination locking assembly (i.e. the 'correct' combination of characters for causing the combination locking assembly to be in the unlocked configuration), the user aligns the dials into the current correct combination of characters, so that the shank can be moved away from the housing part. With the dials aligned in the current correct combination, the user moves the shank the first distance away from the housing part, such that the first end of the shank is withdrawn from the housing part. The user then rotates the shank about its second end through a given angle (commonly 90° or 180°).

With the shank rotated to the given angle, the user either moves the shank further away from the housing part (i.e. to a second distance greater than the first distance but such that the second end of the shank is still held within its corresponding recess), or causes the shank to move back towards the housing part (i.e. so that the second end of the shank is pushed deeper into its corresponding recess in the housing part but the first end is not within the first end's corresponding recess).

This action causes the combination locking assembly to enter a combination setting mode. The user may need to apply a force to the shank and/or housing part (e.g. by pulling or pushing) to overcome a bias which attempts to return the shank to a given displacement relative to the housing part (e.g. the first distance). Furthermore, the user may need to continue applying the force so that the shank remains at the required displacement relative to the housing part while the user sets the combination. Alternatively, the user may be able to rotate the shank to an angle at which the shank is held by the housing part at the right displacement (i.e. the shank is held at the second distance or the second end of the shank is held deeper within its corresponding recess).

When the shank is held in the correct position, the combination locking assembly is in the combination setting mode. With the combination locking assembly in the combination setting mode, the user moves the dials to align a new combination of characters with the feature of the housing part.

When the user has aligned the dials in the desired new combination, the user takes the combination locking assembly out of combination setting mode by moving the shank to the position in which it is the first distance away from the housing part, rotating the shank relative to the housing part back through the predetermined angle, and moving the shank towards the housing part so that the first end of the shank is received in the corresponding recess in the housing part. The user can then move the dials away from the new combination so that the combination locking assembly moves from the unlocked configuration to the locked configuration.

Causing the combination locking assembly to enter the combination setting mode as described above can be difficult because the steps that the user must take to cause entry into the combination setting mode are not intuitive and are easily forgotten if the user does not perform resetting of the combination frequently.

Furthermore, users are often unsure whether or not the combination locking assembly has successfully entered the combination setting mode, i.e. it is not clear whether the shank has been rotated sufficiently relative to the housing part, and/or it is not clear whether the shank has been displaced sufficiently relative to the housing part, and/or it is not clear whether the user needs to keep the shank and the housing part a certain distance apart from one another or to push the shank and the housing part together in order to cause the combination locking assembly to enter or remain in the combination setting mode.

Additionally, particularly for smaller padlocks, manipulating a padlock through the steps that are required to enter and leave the combination setting mode can be fiddly. This may make it difficult for people—particularly those with limited motor control or low hand strength—to operate a combination padlock.

The invention aims to go some way towards overcoming or at least ameliorating one or more of the above problems.

SUMMARY OF THE INVENTION

Accordingly there is provided a combination padlock comprising: a combination locking assembly operable between a locked configuration and an unlocked configuration; a first housing part; and a second housing part connected to the first housing part, the second housing part being movable relative to the first housing part when the locking assembly is in the unlocked configuration, wherein the second housing part is configured to cause the combination locking assembly to enter a combination setting mode when the second housing part is moved relative to the first housing part.

Preferably the second housing part is configured to cause the combination locking assembly to enter the combination setting mode when the second housing part is moved away from the first housing part, more preferably when the second housing part is moved axially away from the first housing part. Preferably the second housing part is configured to cause the combination locking assembly to enter the combination setting mode when the second housing part is rotated relative to the first housing part. Combination setting mode may be entered via movement of the second housing part away from the first housing part, preferably axially, then subsequent rotation of the second housing part relative to the first housing part.

Accordingly there is provided a combination padlock comprising: a combination locking assembly operable between a locked configuration and an unlocked configuration; a first housing part which is an upper housing part; and a second housing part connected to the first housing part, the second housing part being a lower housing part, the second housing part being movable relative to the first housing part when the locking assembly is in the unlocked configuration, the second housing part having an upper surface facing towards the first housing part, wherein the padlock is configured such that the combination locking assembly is caused to enter a combination setting mode by movement of the second housing part axially away from the first housing part and the padlock is configured such that rotation of the second housing part relative to the first housing part exposes at least part of the upper surface of the second housing part and maintains the second housing part at its axial displacement from the first housing part, whereby the combination locking assembly is maintained in combination setting mode.

Preferably the padlock includes at least one stop configured to prevent the second housing part from rotating beyond a predetermined angle relative to the first housing part.

Preferably the padlock comprises biasing means configured to bias the second housing part towards the first housing part. Preferably the biasing means includes at least one spring.

Preferably the padlock includes a helical screw thread mechanism. Preferably one of the first housing part and the second housing part includes a male screw thread part and the other of the first housing part and the second housing part includes a female screw thread part. Preferably the male screw thread part and the female screw thread part are configured to engage one another. Preferably the second housing part is arranged to move away from the first housing part when the second housing part rotates in one direction along the screw thread parts and to move towards the first housing part when the second housing part rotates in the opposite direction along the screw thread parts. Preferably the first housing part includes the male screw thread part and the second housing part includes the female screw thread part.

Preferably the padlock is configured such that the combination locking assembly is caused to enter combination setting mode when the second housing part is moved axially away from the first housing part and the padlock is configured such that rotation of the second housing part relative to the first housing part maintains the second housing part at its axial displacement from the first housing part, whereby the combination locking assembly is maintained in combination setting mode. The second housing part preferably includes an extension extending therefrom which is integral with or rigidly coupled to the second housing part and which extends into the interior cavity of the first housing part and is axially moveable and rotatable with respect to the first housing part, the extension having at least one formation and the first housing part having a corresponding formation on its interior that is engageable with said at least one formation on the extension, the padlock being configured to cause the combination locking assembly to enter combination setting mode when the second housing part is moved axially away from the first housing part, subsequent rotation of the second housing part relative to the first housing part causing said corresponding formations to engage with one another, preventing the combination locking assembly from moving out of combination setting mode whilst the corresponding formations are engaging with one another. The extension of the second housing part may be a spindle.

Preferably the padlock includes at least one recess in at least one of the first and second housing parts and includes at least one corresponding protrusion on at least the other of the first and second housing parts, said at least one recess and said at least one corresponding protrusion being engageable with one another. Preferably the combination locking assembly is operable between the combination setting mode and a normal mode, wherein said at least one protrusion engages with said at least one corresponding recess in the other of the housing parts when the padlock is in normal mode. Preferably said at least one recess and said at least one corresponding protrusion are complementary in shape. Preferably the protrusion protrudes from an edge of the first housing part or the second housing part. Preferably the protrusion and the exterior surface form a substantially continuous surface. Preferably the protrusion creates a stepped profile to the edge of the first housing part or the second housing part. Preferably the protrusion protrudes from a surface of the first housing part or the second housing part. Preferably the protrusion protrudes in a direction substantially orthogonal to the plane of the surface.

Preferably the first housing part has an exterior surface and the second housing part has an exterior surface, and wherein the first and second housing parts are sized and shaped such that when the combination locking assembly is not in the combination setting mode the exterior surfaces of the first and second housing parts form a substantially continuous surface.

Preferably the first housing part has a lower surface facing towards the second housing part and the second housing part has a corresponding upper surface facing towards the first housing part, the padlock having an equilibrium configuration in which the upper surface of the second housing part is flush with the lower surface of the first housing part, the second housing part being rotatably connected to the first housing part, and wherein, when the combination locking assembly is in the combination setting mode, the second housing part having been rotated relative to the first housing part, at least part of the upper surface of the second housing part is exposed.

Preferably the combination padlock further includes a key-operated locking assembly. At least the second housing part may be provided with an at least partially textured surface. Preferably the first housing part and the second housing part are moulded housing parts.

BRIEF DESCRIPTION OF THE DRAWINGS

Specific embodiments of the invention will now be described by way of non-limiting examples, in which.

DETAILED DESCRIPTION

The present embodiments represent the best ways currently known to the applicant of putting the invention into practice, but they are not the only ways in which this can be achieved. They are illustrated, and they will now be described, by way of example only.

Figure 1:
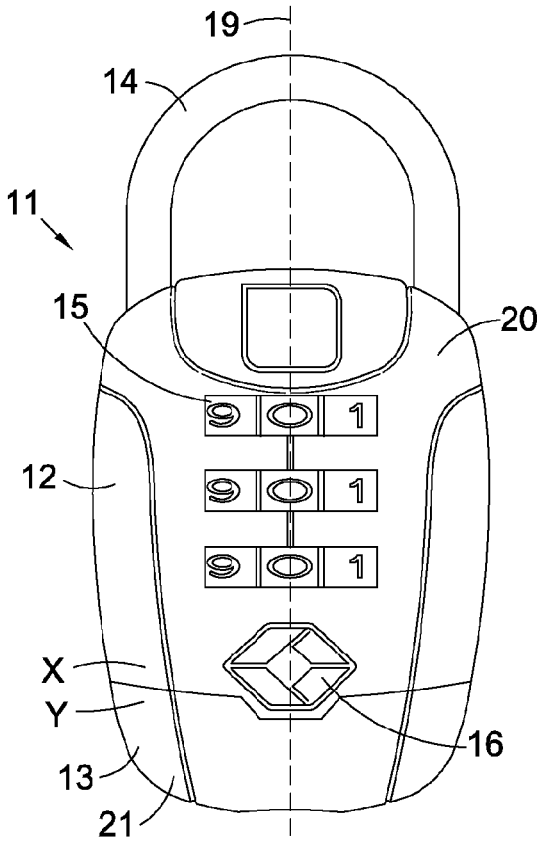
FIG. 1 schematically illustrates an embodiment of a combination padlock with a combination locking assembly in an unlocked configuration.
Figure 4A:
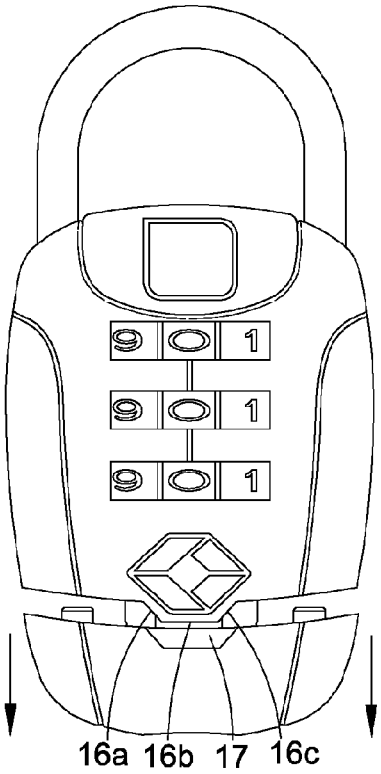
FIGS. 4*a*-4*c* schematically illustrate an embodiment of a combination padlock with a combination locking assembly moving into and out of a combination setting mode.
Figure 4B:
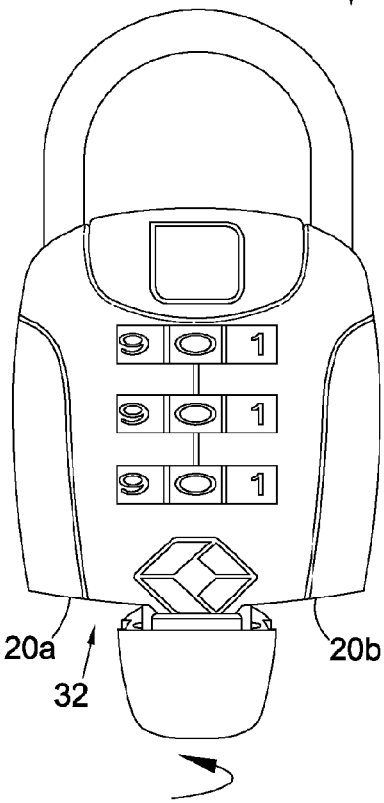

FIG. 1 illustrates a combination padlock 11. The padlock 11 includes a first housing part 12 and a second housing part 13 which are connected to one another in such a way that the housing parts 12, 13 can be moved relative to each other when a combination locking assembly of the padlock 11 is in an unlocked configuration. In particular, the housing parts 12, 13 can be moved axially away from one another (as illustrated in FIG. 4*a* and discussed in more detail below) up to a certain distance, and can be rotated relative to each other (as illustrated in FIG. 4*b* and discussed in more detail below) up to a certain angle. The first housing part is an upper housing part and the second housing part is a lower housing part, the terms upper housing part and lower housing part being used as relative terms to denote the first and second housing parts respectively when the padlock is in the orientation shown in FIG. 1.

As illustrated in FIG. 1, the padlock 11 has at least one axis 19. The padlock 11 also includes: a padlock shank 14 which is approximately U-shaped and arranged such that its ends can be received and retained in recesses of the first housing part 12; a plurality of dials 15 provided with numbers, letters and/or other characters, the dials 15 being rotatable so that characters on the dials 15 can be aligned with a feature or features (not illustrated) of the first housing part 12 and/or a feature or features of the second housing part 13; protrusions 16; and corresponding recesses 17. For example, the front of the first housing part 12 can have an elongate ink filled trench (not shown in the figures) extending parallel with the axis 19 of the padlock as a feature that the dials can be aligned with, but of course the padlock may have any other suitable feature or features that the dials may align with.

The padlock 11 further includes a combination locking assembly (not illustrated) which is operable between a locked configuration and an unlocked configuration. The combination locking assembly controls whether or not shank 14 can be moved relative to first housing part 12 and second housing part 13. The combination locking assembly may be housed by the first housing part 12, the second housing part 13, or both of the first and second housing parts 12, 13.

The combination locking assembly of the padlock 11 in FIG. 1 is in an unlocked configuration. With the combination locking assembly in the unlocked configuration, the shank 14 can be moved away from the housing parts 12, 13. In particular, the shank 14 can be moved axially away from the housing parts 12, 13, i.e. in a direction substantially parallel to the axis 19 of the padlock 11.

When the shank 14 is moved axially away from the housing parts 12, 13, a first end of the shank 14 is withdrawn from a corresponding recess in the first housing part 12. A second end of the shank 14 remains within its corresponding recess in the first housing part 12. The shank 14 is able to pivot about the second end of the shank 14 (i.e. the end which remains within its recess). In this configuration, the padlock 11 may be referred to as 'open'. The open padlock 11 can be applied to, for example, a hasp, a chain, a clasp or another apparatus which can receive the shank 14 of the padlock 11.

The combination locking assembly of padlock 11 can also be in a locked configuration. With the combination locking assembly in the locked configuration, the shank 14 cannot be moved away from the housing parts 12, 13. When the combination locking assembly is in the locked configuration, both ends of the shank 14 are held within recesses of the housing part 12 such that the ends of the shank cannot be removed from the recesses.

Whether the combination locking assembly of the padlock 11 is in the unlocked configuration or the locked configuration depends on whether the correct characters of the dials 15 are aligned with the feature of the housing part. If the correct combination of characters is aligned with the feature, the combination locking assembly will be in the unlocked configuration. If an incorrect combination of characters is aligned with the feature, the combination locking assembly will be in the locked configuration.

In the example of FIG. 1, first housing part 12 and second housing part 13 are moulded housing parts. Each housing part 12, 13 is approximately cuboid in shape but with some tapering and with some curved corners and edges. Each housing part 12, 13 may house one or more parts or components of the padlock 11, such as the combination locking assembly. A part or component of the padlock 11 need not necessarily be housed by one of the housing parts only. A portion of a part or component may be housed by the first housing part 12, and another portion of the same part or component may be housed by the second housing part 13.

Each housing part 12, 13 is provided with exterior surfaces, which may have surface texture and/or surface decoration. The surface texture or surface decoration may cover one or more areas of the housing parts 12, 13, and may provide greater friction for a user gripping the padlock 11 than an equivalent untextured surface. This may help the user manipulate the first and second housing parts 12, 13.

The second housing part 13 may, for example, be provided with an at least partially textured surface. This may make it easier for a user of the padlock 11 to pull the second housing part 13 axially away from the first housing part 12.

The housing parts 12, 13 are sized and shaped such that, when the padlock 11 is in the configuration illustrated in FIG. 1, the exterior surfaces of the housing parts 12, 13 form a substantially continuous surface. More generally, at least one exterior surface of a first housing part 12 lies in approximately the same plane as an adjacent exterior surface of the second housing part 13, and/or is similar in curvature to an adjacent exterior surface of the second housing part 13, and/or meets an adjacent exterior surface of the second housing part 13 at a point or along a line where the two exterior surfaces have approximately the same tangent plane(s), and/or is otherwise complementarily shaped to form a substantially continuous surface with an adjacent exterior surface of the second housing part 13.

In the configuration illustrated in FIG. 1, exterior surface 20 of first housing part 12 is positioned adjacent to exterior surface 21 of second housing part 13. Exterior surfaces 20, 21 meet along a line, as illustrated in the figures. Exterior surface 20 is roughly similar in curvature to exterior surface 21 along the line where the exterior surfaces 20, 21 meet. Exterior surfaces 20, 21 have approximately the same respective tangent planes along the line along which they meet. For instance, the tangent plane of exterior surface 20 at a point X on exterior surface 20 immediately adjacent to the line along which exterior surfaces 20, 21 meet is approximately the same as the tangent plane of exterior surface 21 at a corresponding point Y on exterior surface 21 immediately adjacent to the line along which the exterior surfaces 20, 21 meet (the two points may, in this example, be on a same or similar axial line through the padlock 11, for instance). The exterior surfaces 20, 21, when positioned adjacent to one another as illustrated in FIG. 1, together present one substantially continuous front surface of the padlock 11.

Similarly, the side exterior surfaces of housing parts 12, 13 are similar in curvature to one another and meet along lines along which they have approximately the same respective tangent planes. The rear exterior surfaces of housing parts 12, 13 are also similar in curvature to one another and meet along a line along which they have approximately the same respective tangent planes.

The configuration of padlock 11 illustrated in FIG. 1 may be thought of as a 'normal' mode of the padlock 11. In the normal mode, the combination locking assembly can be locked and unlocked, but the combination locking assembly is not in the combination setting mode.

Figure 2:
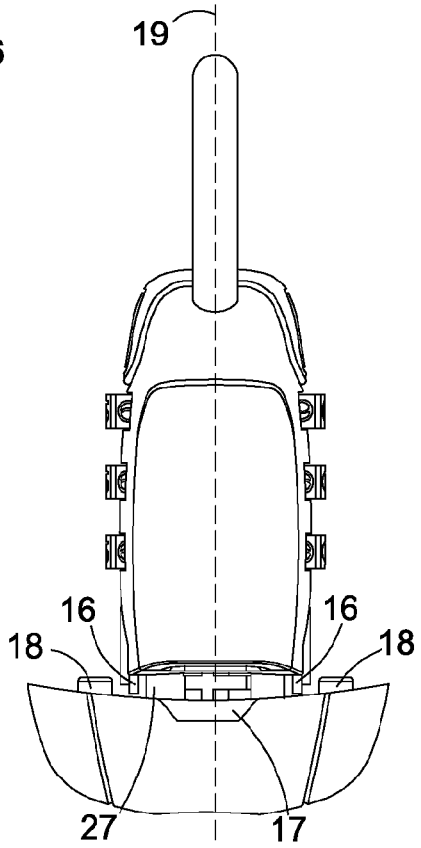
FIG. 2 schematically illustrates in side view an embodiment of a combination padlock with a combination locking assembly in an unlocked configuration and in a combination setting mode.

FIG. 2 illustrates in side view a combination padlock 11 with its combination locking assembly in an unlocked configuration and in a combination setting mode. As illustrated in FIG. 2, first housing part 12 and second housing part 13 have been rotated relative to one another, so that they are at approximately 90° to one another. In this configuration, a user of the padlock 11 can rotate the dials 15 to set a new combination of characters for putting the combination locking assembly in its unlocked mode.

In FIG. 2, it can be seen that first housing part 12 is provided with protrusions 16, and second housing part 13 is provided with protrusions 18. In the illustrated example, the padlock 11 has first and second protrusions 16, and first and second protrusions 18. However, in other examples, first housing part 12 and second housing part 13 may have different numbers of protrusions, including no protrusions, one protrusion from only one of the housing parts 12, 13, or any other arrangement of protrusions. Second housing part 13 is provided with recesses 17 corresponding and complementary in shape to protrusions 16. First housing part 12 is provided with recesses 40 (see FIG. 3*b*) corresponding and complementary in shape to protrusions 18. The numbers of recesses corresponds to the numbers of protrusions. In examples where there are no protrusions, there may also be no recesses.

The protrusions 16 protrude from first housing part 12 as extensions of the front and rear exterior surfaces of first housing part 12. In the illustrated example, the exterior surfaces of the first housing part 12 are slightly curved. The protrusions 16 are similarly curved so as to form a continuous extension in the axial direction of the curved exterior surfaces. If instead the exterior surfaces of the first housing part 12 were planar (i.e. flat), each protrusion 16 could be substantially coplanar with the planar exterior surface. The protrusions 16 may be formed as parts of the exterior surfaces so that the protrusions 16 are integral parts of the first housing part 12, or may be affixed to the exterior surfaces, e.g. using an adhesive or a moulding technique such as two-shot moulding.

The protrusions 16 create 'stepped' profiles to the lower edges of the front and rear exterior surfaces of the first housing part 12. This can be seen in FIGS. 4*a* and 4*b*, for example, in which the lower edge 20*a* of exterior surface 20 is smoothly curved from the left-hand side to the point at which the protrusion 16 protrudes from the exterior surface 20, and the lower edge 20*b* of exterior surface 20 is smoothly curved from the right-hand side to the point at which the protrusion 16 protrudes from the exterior surface 20. The protrusion 16 has a lower edge 16*b* which is approximately parallel to the curved line defined by the lower edges 20*a* and 20*b* of the exterior surface 20, and has two further edges 16*a* and 16*c* which, in the illustrated example, are approximately straight lines joining the edges 20*a*, 16*b* and 20*b*. In some embodiments, one or more of the protrusions 16 may bear a badge, an insignia or another visual mark, such as the Transport Security Administration (TSA) lock symbol.

In the illustrated example, recesses 17 are shallow depressions in the outer surface of second housing part 13. Each recess 17 is shaped to receive a corresponding protrusion 16.

In the illustrated example, each protrusion 18 protrudes from an upper surface 34 of the second housing part 13. The upper surface 34 of the second housing part 13 faces at least partially towards the first housing part 12. Each protrusion 18 protrudes from the upper surface 34 in a direction substantially parallel to the axis 19 of the padlock 11, towards the first housing part 12.

The first housing part 12 has a lower surface 32 which faces towards the second housing part 13 and which is sized and shaped (in particular, has an appropriate degree of curvature—including the possibility of no curvature) so that the lower surface 32 of the first housing part 12 and the upper surface 34 of the second housing part 13 correspond with one another and can meet flushly with one another when the first and second housing parts 12, 13 are aligned with each other.

The lower surface 32 of the first housing part 12 includes the recesses 40 (see FIG. 3*b*) which correspond and are complementary in shape to protrusions 18. Thus the exterior surface of the second housing part 13 has a stepped profile corresponding to the stepped profile of the exterior surface of first housing part 12. Moving the housing parts 12, 13 away from one another and rotating the housing parts 12, 13 relative to one another exposes at least part of the lower surface 32 of first housing part 12 and at least part of the upper surface 34 of second housing part 13.

The recesses and protrusions are engageable with one another. Protrusions 16 can engage with recesses 17, and protrusions 18 can engage with recesses 40. The recesses and protrusions are sized and shaped such that they engage with one another while the housing parts 12, 13 are immediately adjacent to one another and are aligned with one another (i.e. the housing parts 12, 13 are in the configuration illustrated in FIG. 1). In particular, the lengths of the protrusions and the depths of the recesses are such that the protrusions and recesses engage when the first and second housing parts 12, 13 are positioned immediately adjacent to one another and disengage when the first and second housing parts 12, 13 are moved away from one another.

The configuration of the padlock 11 in which first housing part 12 and second housing part 13 are aligned with one another, the lower surface 32 of first housing part 12 being flush with the upper surface 34 of second housing part 13, and the exterior surfaces of the housing parts 12, 13 are flush with one another, giving a substantially continuous surface to the padlock 11, may be an equilibrium configuration of the padlock 11, i.e. a configuration to which the padlock 11 may try to return and/or in which the padlock 11 may attempt to stay. The housing parts 12, 13 may be biased such that they attempt to return to this position, though other components of the padlock 11 (such as protrusions and/or recesses) may in some circumstances prevent the housing parts 12, 13 from returning to the equilibrium position.

Figure 3A:
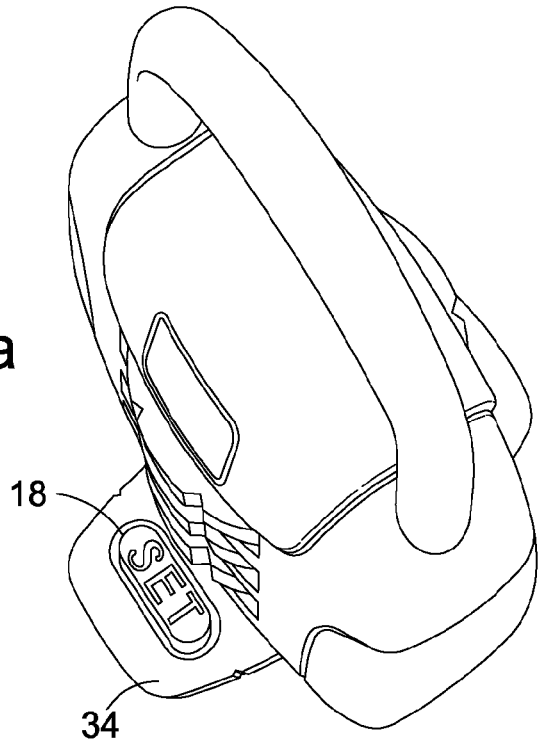
FIG. 3*a* schematically illustrates in top perspective view an embodiment of a combination padlock with a combination locking assembly in an unlocked configuration and in a combination setting mode.

FIG. 3*a* illustrates in top perspective view the padlock 11 of FIG. 2 with its combination locking assembly in the combination setting mode. As can be seen in FIG. 3*a*, the protrusions 18 of second housing part 13 include, in this example, an indicator bearing the word 'set'. The indicator informs a user of the padlock that the combination locking assembly of the padlock 11 is in combination setting mode, i.e. that the user can set a new combination of characters for putting the combination locking assembly of the padlock 11 in its unlocked configuration.

The indicator of protrusion 18 is only revealed when the first housing part 12 and the second housing part 13 have been moved away from one another and rotated relative to one another, i.e. when the combination locking assembly has been put in the combination setting mode. Thus there are at least two clear visible and tangible features of the padlock 11 which inform the user of the padlock 11 that the combination locking assembly is in the combination setting mode: the housing parts 12, 13 are visibly and tangibly at 90° relative to one another, and the protrusions 18 (and their indicators) have been revealed for viewing and/or touching by a user. Thus a user can be certain whether he or she has successfully put the combination locking assembly into combination setting mode.

Figure 3B:
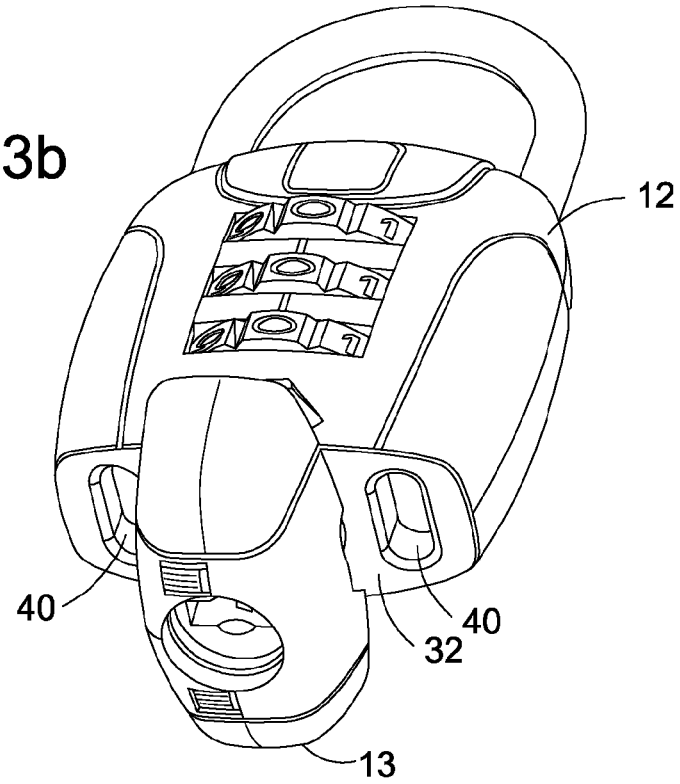
FIG. 3*b* schematically illustrates in bottom perspective view the combination padlock of FIG. 3*a*.

FIG. 3*b* illustrates in bottom perspective view the padlock 11 of FIG. 2 and FIG. 3*a*, with recesses 40 in first housing part 12 visible in the lower surface 32 of first housing part 12. In the embodiment illustrated in FIG. 3*b*, the second housing part 13 also includes an aperture through which a key or other similar entity can be inserted to operate a key-operated locking assembly of the padlock 11, as discussed in more detail below. Embodiments of the padlock 11 which do not include a key-operated locking assembly do not necessarily include an aperture through which a key can be inserted.

Figure 4C:
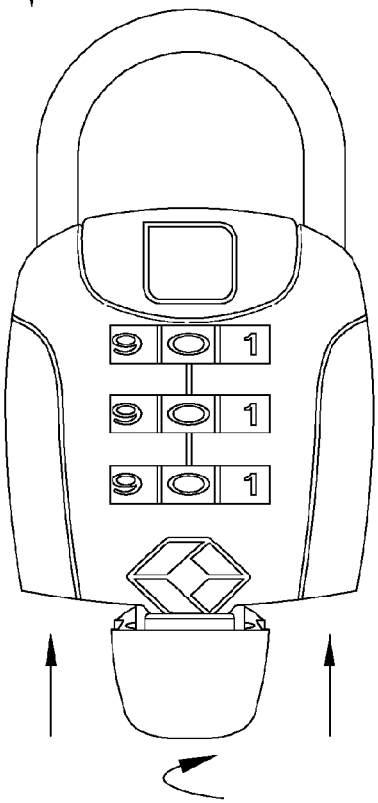

FIGS. 4*a*-4*c* illustrate movements of a padlock that put the combination locking assembly of the padlock into the combination setting mode.

FIG. 4*a* illustrates the padlock 11 with its combination locking assembly in unlocked configuration (i.e. with the correct character or combination of characters aligned with the feature of the first housing part 12 or second housing part 13) and with the housing parts 12, 13 aligned with one another and positioned immediately adjacent to one another.

As indicated by the arrows in FIG. 4*a*, the second housing part 13 is moved, relative to the first housing part 12, axially away from the first housing part 12, withdrawing protrusions 16 of first housing part 12 from their corresponding recesses 17 in second housing part 13, and withdrawing protrusions 18 of second housing part 13 from their corresponding recesses 40 in first housing part 12.

Moving the second housing part 13 away from the first housing part 12 may involve overcoming biasing means (such as a spring or other elastic component) which is configured to bias the second housing part 13 towards the first housing part 12. The biasing means may help to prevent the combination locking assembly from being inadvertently put in the combination setting mode and the 'correct' combination for putting the combination locking assembly in the unlocked configuration from being inadvertently changed.

In some embodiments, moving the second housing part 13 a predetermined distance away from the first housing part 12 may be sufficient to put the combination locking assembly into the combination setting mode. Moving the second housing part 13 away from the first housing part 12 may arrange internal clutches of the combination locking assembly such that the combination locking assembly is in the combination setting mode and the dials 15 can be rotated to set a new 'correct' combination of characters.

To prevent the user from needing to hold the first housing part 12 and the second housing part 13 away from one another to keep the combination locking assembly in combination setting mode, the padlock 11 may be provided with features which can restrict the movement of the second housing parts 13 axially towards the first housing part 12. For example, in some embodiments, a user may rotate the housing parts 12, 13 so that at least part of the lower surface 32 of the first housing part 12 rests against at least part of the upper surface 34 of the second housing part 13, keeping the housing parts 12, 13 the predetermined distance away from each other. In the illustrated example, a spindle 27 of the padlock 11 (see FIGS. 6 and 7) is configured such that it can keep the housing parts 12, 13 the predetermined distance away from each other, as will be described in more detail below.

FIG. 4*b* illustrates the padlock 11 after the first housing part 12 and the second housing part 13 have been rotated through a predetermined angle (in this case 90°) relative to one another (as indicated by the arrow beneath padlock 11 in FIG. 4*b*). When the housing parts 12, 13 have been rotated through the predetermined angle, the protrusions 18 are exposed for the user to view and feel, confirming that the combination locking assembly is in the combination setting mode.

In embodiments which include biasing means, the biasing means may, after the first and second housing parts 12, 13 have been rotated relative to one another through the predetermined angle, cause the second housing part 13 to return a small distance towards the first housing part 12 if the user stops applying a force to move or keep the second housing part 13 away from the first housing part 12. The padlock 11 is however configured such that, when the housing parts 12, 13 have been rotated relative to one another, the housing parts 12, 13 are kept a sufficient distance apart for the combination locking assembly to be kept in the combination setting mode (even if the housing parts 12, 13 do return a short distance towards each other). This may be achieved by a spindle 27 of the padlock 11 (as explained below in the context of FIGS. 5 to 7), by virtue of the housing parts 12, 13 resting against one another under the action of the biasing means, or by other suitable means.

The upper surface 34 of the second housing part 13 and the lower surface 32 of the first housing part 12 may for example be arranged such that, when the housing parts 12, 13 are rotated relative to one another and the biasing means returns the second housing part 13 a small distance towards the first housing part 12, the lower and upper surfaces 32, 34 rest against one another in such a way as to keep the housing parts 12, 13 sufficiently far apart that the combination locking assembly remains in the combination setting mode. The edges of one or both of the housing parts 12, 13 may for example be raised edges which rest against the opposing housing part to keep the housing parts 12, 13 sufficiently far apart.

Alternatively or additionally, the protrusions 16 and/or 18 may be configured to rest against or in the surface of the opposite housing part to keep the first and second housing parts 12, 13 a sufficient distance apart when the housing parts 12, 13 have been rotated relative to each other.

Other means for keeping the housing parts 12, 13 a sufficient distance apart may also be provided, such as additional protrusions or internal means for counteracting or disabling the biasing means when the housing parts 12, 13 have been rotated relative to one another.

With the padlock 11 in the configuration shown in FIG. 4*b*, the combination locking assembly is in the combination setting mode. The user of the padlock 11 can move the dials 15 to choose a new combination of characters for putting the combination locking assembly in its unlocked configuration, by moving the dials 15 to align the new characters with the feature(s) of the first housing part 12 and/or the second housing part 13.

Once the user has aligned the dials 15 into the desired combination, the user rotates the housing parts 12, 13 relative to one another back (in the opposite direction to before) through the predetermined angle (90° in the illustrated example), as indicated by the curved arrow in FIG. 4*c*. In some embodiments, the user may need to move the housing parts 12, 13 slightly away from one another to be able to rotate the first and second housing parts 12, 13 from the configuration illustrated in FIG. 4*b* to the configuration illustrated in FIG. 4*a*. The protrusions 16, 18 might impede rotational motion of the housing parts 12, 13 relative to one another unless the housing parts 12, 13 are moved slightly away from one another so that the protrusions 16, 18 do not rest on or in the opposing housing parts.

Figure 5:
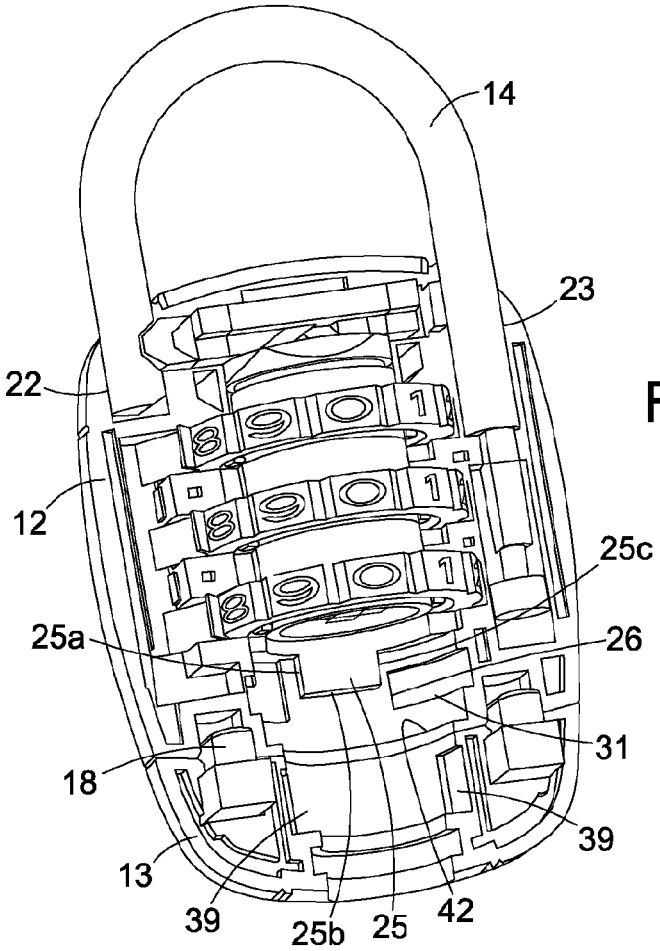
FIG. 5 schematically illustrates an interior of an embodiment of a combination padlock.

FIG. 5 schematically illustrates an interior of the padlock 11, including an interior cavity in which a spindle 27 (see FIG. 6) resides. The front of the first housing part 12, the spindle 27 and some other internal elements of the padlock 11 are not shown in FIG. 5 so that features of the housing parts 12, 13 which would have been obscured by the spindle 27 and other internal elements are visible.

FIG. 5 illustrates recesses 22, 23 in the first housing part 12 which can receive and retain the first and second ends of the shank 14. FIG. 5 also illustrates a stop 25 which can keep the first and second housing parts 12, 13 a sufficient axial distance apart for the combination locking assembly to be kept in the combination setting mode, and/or which can prevent the second housing part 13 from rotating beyond the predetermined angle relative to the first housing part 12, as described in more detail below. In some embodiments, there may be only one stop 25. However, in other embodiments, there may be several such stops positioned at different points around the circumference of the first housing part 12. In the illustrated example, an identical stop is provided at an opposite point on the first housing part 12 (i.e. at approximately 180° to the illustrated stop 25). The opposing stop is not included in the illustration of FIG. 5 as it would obscure other features of the padlock 11. In the illustrated example a second stop 26 to prevent the second housing part 13 from rotating beyond the predetermined angle relative to the first housing part 12 is provided on the first housing part 12, there being a further stop (not shown) identical to stop 26 at an opposite point on the first housing part 12.

In the illustrated example, the first housing part 12 includes an internal cylinder enclosing a cylindrical interior cavity. Stop 25 is a projection from the internal cylinder of the first housing part 12, the stop 25 having approximately the same curvature as the cylinder, though in other examples the stop 25 need not be curved. The stop 25 projects from the internal cylinder in a direction roughly parallel to the axis 19 of the padlock, and extends for a portion of the circumference of the cylinder. The stop 25 includes surfaces 25*a* and 25*c* which extend in a direction approximately parallel to the axis 19 of the padlock 11 and face in directions roughly orthogonal to the axis of the padlock 11 (i.e. which face in directions which are roughly tangential to the curved wall of the internal cylinder in the illustrated example). The stop 25 also includes a surface 25*b* which extends in a direction approximately orthogonal to the axis 19 of the padlock 11 and faces in a direction approximately parallel to the axis 19 of the padlock 11. The second stop 26 is a surface extending parallel to the axis 19 of the padlock and forms the end of a recessed channel 31 extending partway around the internal cylinder of the first housing part.

Figure 6:
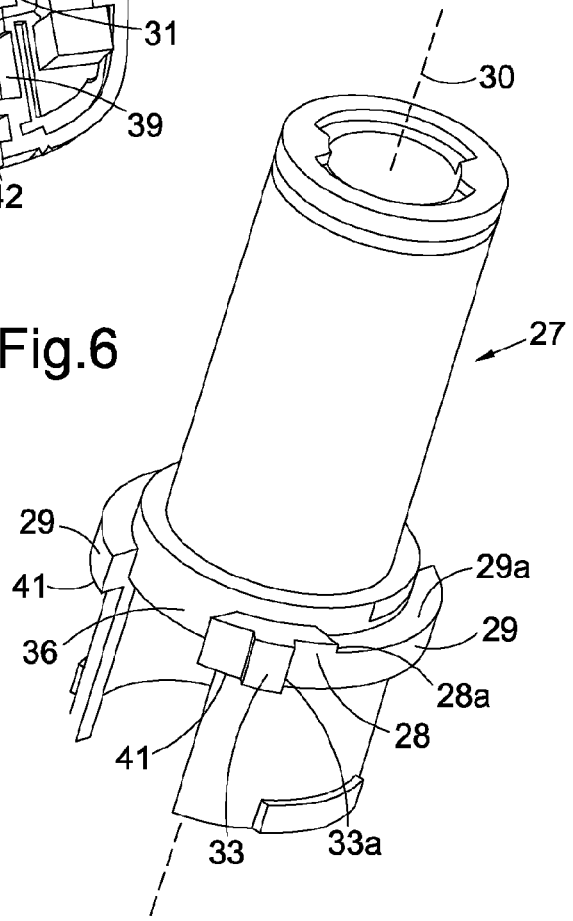
FIG. 6 schematically illustrates a spindle of one embodiment of a combination padlock.

FIG. 6 illustrates a spindle 27 of the padlock 11, with an axis 30. Spindle 27 and second housing part 13 are attached to one another such that spindle 27 and second housing part 13 move substantially together relative to the first housing part 12. In particular, the spindle 27 is sized and shaped such that it can move axially and rotate within the cylindrical interior cavity of the first housing part 12 illustrated in FIG. 5. When the spindle 27 is within the padlock 11 (i.e. during ordinary operation of the padlock 11), the axis 30 of the spindle 27 and the axis 19 of the padlock 11 may be roughly parallel and may coincide with one another (i.e. may be collinear).

The spindle 27 includes at least one spindle edge 28 and at least one spindle tip 29. The spindle edge 28 includes a surface 28*a* which extends in a direction approximately parallel to the axis 30 of the spindle and which faces in a direction approximately orthogonal to the axis 30 of the spindle 27. The spindle tip 29 includes a surface 29*a* which extends in a direction roughly orthogonal to the axis 30 of the spindle 27 and which faces in a direction roughly parallel to the axis 30 of the spindle 27. Protruding outwardly from the side of the spindle edge 28 is a spindle protrusion 33 having a surface 33*a* which extends in a direction approximately parallel to the axis 30 of the spindle and which faces in a direction approximately orthogonal to the axis 30 of the spindle 27. In the illustrated example, there are two spindle edges 28, two spindle tips 29 and two spindle protrusions 33, the spindle edges 28 positioned on opposite sides of the spindle 27 from one another (i.e. separated by approximately 180° around the spindle 27), the spindle tips 29 positioned on opposite sides of the spindle 27 from one another (i.e. separated by approximately 180° around the spindle 27) and the spindle protrusions 33 positioned on opposite sides of the spindle 27 from one another (i.e. separated by approximately 180° around the spindle 27). In other examples, there may be other numbers of spindle tips 29, spindle edges 28 and spindle protrusions 33, such as only one of each, or more than two of each.

When the spindle 27 is within the interior cavity of the padlock 11 for ordinary operation of the padlock 11 and the padlock 11 is in 'normal' mode (not configuration setting mode), stop 25 is positioned in a recess 36 of the spindle 27. The second, not-illustrated stop discussed above may be positioned in a not-illustrated recess of the spindle 27, and the following description may apply equally to the second, not-illustrated stop.

When the stop 25 is in recess 36, the stop 25 prevents the spindle 27 from rotating within the internal cylinder. The surfaces 25*a*, 25*c* of the stop 25 are arranged such that they can abut corresponding surfaces of the spindle edge 28 and/or spindle tip 29 to prevent the spindle 27 from rotating (or to limit the spindle 27 to rotating through only a small angle). The stop 25 extends axially into the recess 36 from the internal cylinder of the first housing part 12. In this configuration, a lower surface of the internal cylinder may contact an upper surface of the spindle edge 28, which prevents the spindle 27 (and attached second housing part 13) from moving axially further towards the first housing part 12. Alternatively, the lower surface of the internal cylinder and the upper surface of the spindle edge 28 may not contact each other, and instead different parts of the padlock 11 (such as lower surface 32 of first housing part 12 and upper surface 34 of lower housing part 13) may prevent the spindle 27 (and attached second housing part 13) from moving axially further towards the first housing part 12.

When the combination locking assembly of padlock 11 is to be put into its combination setting mode, the user of the padlock 11 first applies a force to the second housing part 13 to move the second housing part 13 (and attached spindle 27) axially away from the first housing part 12. Moving the second housing part 13 (and spindle 27) a certain distance away from the first housing part 12 removes the stop 25 from the recess 36, allowing the second housing part 13 and spindle 27 to rotate relative to the first housing part 12.

The user of the padlock 11 then rotates the second housing part 13 through a sufficiently large angle that at least part of surface 25*b* of the stop 25 overlaps with and can contact at least part of surface 29*a* of spindle tip 29 to prevent the spindle 27 and second housing part 13 from moving axially towards the first housing part 12. The user may then stop applying the force to move the second housing part 13 and spindle 27 away from the first housing part 12. The second housing part 13 and spindle 27 may move slightly towards the first housing part 12, until the surfaces 25*b* and 29*a* contact and engage with each other. Surfaces 25*b* and 29*a* contacting each other prevents the second housing part 13 from moving further towards the first housing part 12. The relative axial movement of the first and second housing parts 12, 13 is restricted by the stop 25 and the spindle tip 29 contacting each other.

In this configuration (in which surface 25*b* of stop 25 contacts surface 29*a* of spindle tip 29), the stop 25 occupies part of a cavity which is defined by the spindle edge 28 and the spindle tip 29 and which extends part of the way round the circumference of the spindle 27 (for the circumferential length of the surface 29*a* of spindle tip 29).

While the stop 25 occupies part of the cavity defined by the spindle edge 28 and the spindle tip 29 (i.e. while the surface 25*b* contacts and engages or almost contacts and engages with surface 29*a*), the spindle 27 is able to rotate about its axis 30 until one of the surfaces of spindle edge 28 which extends in a direction approximately parallel to axis 30 (e.g. surface 28*a*) contacts a corresponding surface of the stop 25 (e.g. surface 25*c*). Contact of surface 25*c* with surface 28*a* defines a predetermined angle that the spindle can rotate through. When the spindle has been rotated by the predetermined angle, surface 33*a* of spindle protrusion 33 contacts second stop 26 on the first housing part 12, therefore acting as a second stop means to prevent further rotation. In some embodiments, there may of course be no spindle protrusion 33 and no corresponding second stop 26 acting as a second stop means. The surfaces 25*b*, 29*a* may in some embodiments be low-friction surfaces which provide only a small resistance to the relative rotation of the first and second housing parts 12, 13 while the surfaces 25*b*, 29*a* are in contact.

The sizing, shaping and positioning of the stop 25, the spindle edge 28 and the spindle tip 29 define the predetermined angle through which the spindle 27 can rotate before the stop 25 makes contact with the spindle edge 28. The longer the circumferential extension of the stop 25 and/or the shorter the circumferential extension of the cavity defined by the spindle edge 28 and the spindle tip 29, the smaller the angle through which the spindle 27 can rotate. However, while the stop 25 occupies the cavity and the surface 25*b* contacts the surface 29*a*, the second housing part 13 cannot move towards the first housing part 12. The user is prevented from rotating the first and second housing parts 12, 13 relative to each other beyond the predetermined angle by the abutment of one of the surfaces 25*a*, 25*c* of the stop 25 of the first housing part 12 with one of the surfaces (e.g. 28*a*) of a spindle edge 28.

In some examples, the action of moving the second housing part 13 axially away from the first housing part 12 (e.g. such that the stop 25 is withdrawn from the recess 36) may be sufficient to cause the combination locking assembly to enter the combination setting mode. It may not be necessary to rotate the second housing part 13 relative to the first housing part 12 to cause the combination locking assembly to enter the combination setting mode. In such examples, the action of rotating the second housing part 13 relative to the first housing part 12 so that surfaces 25*b* and 29*a* at least partially overlap may simply provide additional convenience, in that the user of the padlock 11 does not need to hold the second housing part 13 axially away from the first housing part 12 while setting a new combination, because the surfaces 25*b* and 29*a* can contact each other and keep the housing parts 12, 13 apart.

In other examples, the action of moving the second housing part 13 axially away from the first housing part 12 (e.g. such that the stop 25 is withdrawn from the recess 36) may not be sufficient to cause the combination locking assembly to enter the combination setting mode. In such examples, the action of rotating the second housing part 13 relative to the first housing part 12 may be required to cause the combination locking assembly to enter combination setting mode. In such examples, the spindle tip 29 may be arranged such that its surface 29*a* forms a roughly helical line around the spindle 27. This may be achieved by a variable thickness of the spindle tip 29 around the circumference of the spindle 27, or by mounting the spindle tip 29 in a plane which is not orthogonal to the axis of the spindle 27, such that the spindle tip 29 traces a helical path around the spindle 27. As a consequence, rotating the second housing part 13 relative to the first housing part 12 while the surface 25*b* of the stop 25 and the surface 29*a* of the spindle tip 29 are in contact may cause the first and second housing parts 12, 13 to move further apart by virtue of the contact between the stop 25 and the spindle tip 29.

The spindle 27 is affixed to the second housing part 13 so that the spindle 27 and the second housing part 13 rotate substantially together relative to the first housing part 12, i.e. so that the spindle 27 rotates within the interior cavity of the first housing part 12 when the second housing part 13 is rotated by a user of the padlock 11. The spindle 27 may for instance be formed as an integral part of the second housing part 13, or may be fixed to the second housing part 13 by means of an adhesive, a moulding process, a snap- or push-fit mechanism, or another suitable fixing means or method. In the illustrated example, the spindle 27 and the second housing part 13 are fixed together by means of protrusions 38 which protrude from spindle 27 and which, during normal operation of the padlock 11, are positioned within corresponding recesses 39 in second housing part 13 (see FIGS. 5 to 7).

The protrusions 38 and recesses 39 correspond in circumferential size and shape such that the protrusions 38 fill the recesses 39 in a circumferential direction and force can be transferred between the spindle 27 and the second housing part 13 by means of the contact surfaces of the protrusions 38 and corresponding recesses 39. In particular, the protrusions 38 and recesses 39 are arranged such that rotational movement of the second housing part 13 relative to the first housing part 12 effects rotational movement of the spindle 27, by virtue of forces transferred between the contact surfaces of the protrusions 38 and the recesses 39.

Additionally, an upper surface of a protrusion 38 is arranged such that it can abut a lip/shoulder of a recess 39 (as viewed in FIG. 7) to allow force to be transferred from the second housing part 13 to the spindle 27 to pull the spindle 27 axially away from the first housing part 12. In this way, a user applying a force to the second housing part 13 to move the second housing part 13 axially away from the first housing part 12 causes the spindle 27 to move axially away from the first housing part 12 within the first housing part 12.

A biasing force may be applied (e.g. by a spring or other biasing component of the padlock 11) to the spindle 27 to try to move the spindle 27 axially towards the first housing part 12. The biasing force may attempt to cause surface 29*a* of the spindle tip 29 to directly abut surface 25*b* of stop 25, or may try to cause the stop 25 to enter the recess 36, depending on the relative angular position of the first and second housing parts 12, 13 (and therefore the relative angular position of the first housing part 12 and the spindle 27). However, a user of the padlock 11 applying a sufficient force to the second housing part 13 to overcome the biasing force can move the spindle 27 axially away from the surface 25*b* of the stop 25.

Features of the first housing part 12 and the spindle 27 may prevent the user from moving the spindle 27 (and thus the second housing part 13) beyond a certain distance axially away from the first housing part 12. First housing part 12 may for instance include a protrusion (e.g. a lip or a shoulder) against which part of the spindle 27 can abut to prevent the spindle 27 (and thus the second housing part 13) from moving too far away from the first housing part 12. In the illustrated example, an underside 41 of spindle tip 29 (as viewed in FIG. 6) is arranged such that it can abut a lip/shoulder 42 of first housing part 12 if second housing part 13 is moved a certain distance axially away from first housing part 12. The underside 41 of spindle tip 29 may abut the lip/shoulder 42 of first housing part 12 directly, or may abut an intervening component or intervening components to abut the lip/shoulder 42 indirectly.

The stop 25 and the spindle edge 28 each extend in a direction approximately parallel to the axes 19, 30 sufficiently far that the stop 25 and the spindle edge 28 at least partially overlap in the direction approximately parallel to the axes 19, 30. In other words, irrespective of the axial separation between surfaces 25*b* and 29*a* (within the limits defined by the underside 41 of the spindle tip 29 and the lip/shoulder 42, for example), portions of the surfaces of the stop 25 and spindle edge 28 which extend in a direction approximately parallel to the axes 19, 30 (25*c* and 28*a*, for example) will overlap in the direction approximately parallel to the axes 19, 30. As a consequence, the spindle edge 28 will contact the stop 25 if the first and second housing parts 12, 13 are rotated sufficiently far relative to one another, no matter how far the user of the padlock 11 has pulled the second housing part 13 away from the first housing part 12 within the range allowed by the features 41, 42.

Figure 7:
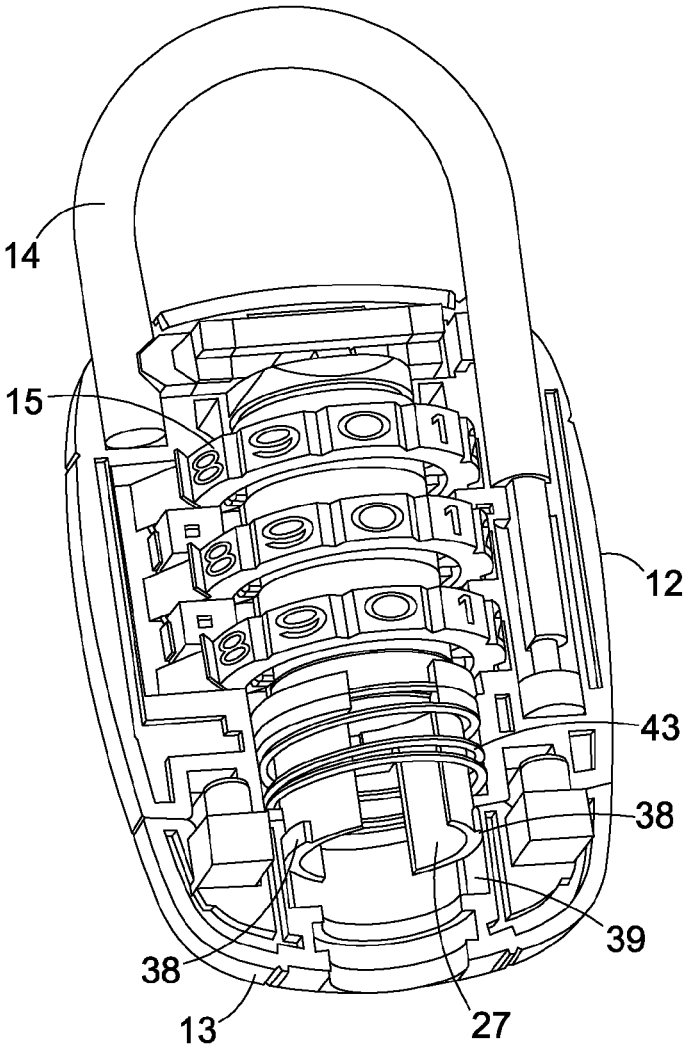
FIG. 7 schematically illustrates an interior of an embodiment of a combination padlock.

FIG. 7 illustrates an interior of the padlock 11 including some of the interior features of the padlock 11 that were not illustrated in FIG. 5. These include, for example, the spindle 27 and biasing means (in this example a spring 43) for applying a force to the second housing part 13 to try to move the second housing part 13 towards the first housing part 12.

Figure 8A:
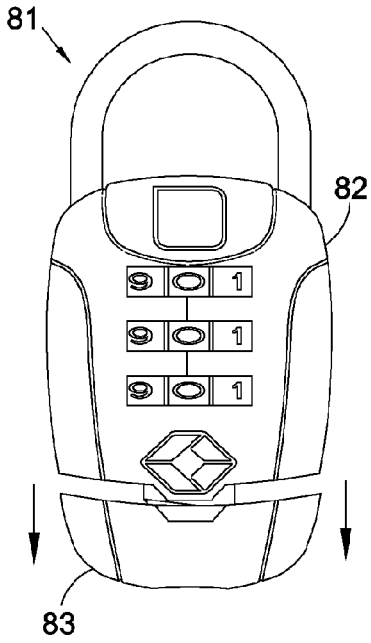
FIGS. 8*a*-8*c* illustrate an alternative embodiment of a combination padlock with a combination locking assembly moving into and out of a combination setting mode.
Figure 8B:
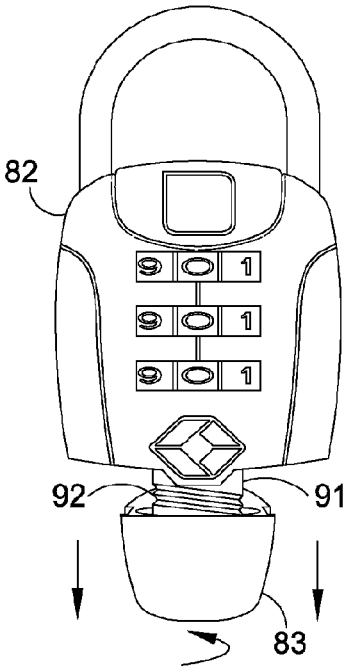
Figure 8C:
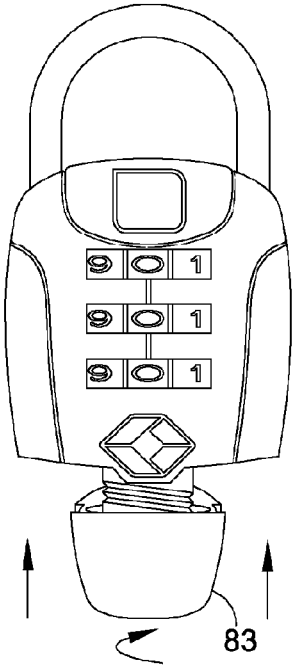

FIGS. 8*a*-8*c* illustrate an alternative combination padlock 81 moving into and out of a combination setting mode. The padlock 81 includes a first housing part 82 and a second housing part 83 which are similar in form to the first and second housing parts 12, 13 of the padlock 11 of FIGS. 1-7.

Padlock 81 also includes a helical screw thread mechanism. In the illustrated example, a cylindrical shaft 91 protrudes from the first housing part 82. The cylindrical shaft 91 of the first housing part includes a male screw thread part 92. The second housing part 83 includes a female screw thread part on an interior part (not shown) of the second housing part 83. The male screw thread part and the female screw thread part are configured to engage one another. The male and female screw thread parts may, for example, have corresponding pitches, corresponding major and minor diameters, and corresponding pitch diameters. The screw threads may also have other corresponding properties, such as corresponding thread tapers. In other examples, the cylindrical shaft 91 of the first housing part 82 may include a female screw thread part, and the second housing part 83 may include a male screw thread part.

Figure 10:
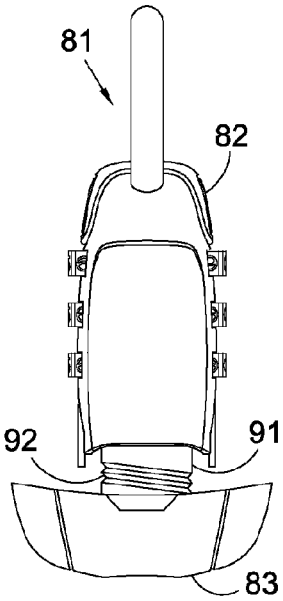
FIG. 10 illustrates in side view the embodiment of FIGS. 8*a*-8*c* and FIG. 9.

As illustrated in FIG. 8*a*, a user of the padlock 81 moves the second housing part 83 away from the first housing part 82, e.g. by applying a pulling force to the second housing part 83. Moving the second housing part 83 away from the first housing part 82 reveals the cylindrical shaft 91 including the male screw thread part 92. As can be seen in FIG. 8*b* and FIG. 10, the cylindrical shaft 91 also has an unthreaded section at the end nearest the first housing part 82.

When the user of the padlock 81 has moved the housing parts 82, 83 a sufficient distance apart, the male screw thread part 92 of the first housing part 82 will be in contact with the female screw thread part on the interior collar of the second housing part 83.

Once the female screw thread part and the male screw thread part are in contact with one another, the user may rotate the second housing part 83 relative to the first housing part 82 in a first direction, as indicated by the curved arrow in FIG. 8*b*. This rotation causes the male and female screw thread parts to engage one another.

As the user continues to rotate the first and second housing parts 82, 83 relative to each other and the second housing part 83 rotates along the screw thread parts (i.e. along the helical path defined by the screw thread parts), the second housing part 83 moves further away from the first housing part 82, as indicated by the downward arrows in FIG. 8*b*, as well as rotating relative to the first housing part 82. The additional separation distance between the housing parts 82, 83 causes a combination locking assembly of the padlock 81 to enter its combination setting mode. The user of the padlock 81 is then able to align dials of the padlock 81 with a feature or features of one or both of the housing parts 82, 83 to set a new 'correct' combination of characters to put the padlock 81 in its unlocked configuration.

When the user has aligned the dials of the padlock 81 into the desired combination of characters, the user rotates the second housing part 83 relative to the first housing part 82, in the opposite direction to the previous direction of rotation (as indicated by the curved arrow in FIG. 8*c*). This causes the second housing part 83 to move towards the first housing part 82, as indicated by the upward arrows in FIG. 8*c*. When the second housing part 83 has reached the end of the helical curve defined by the screw thread parts, the screw thread parts disengage one another, and the second housing part 83 can be moved towards the first housing part 82 so that the housing parts 82, 83 abut one another, as illustrated in FIG. 9.

Figure 9:
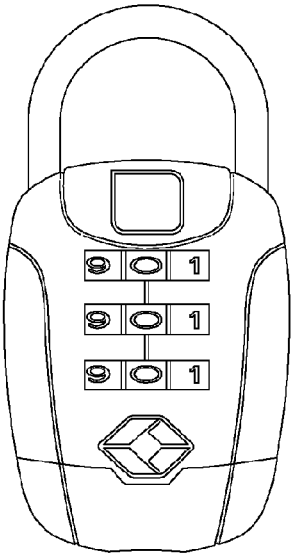
FIG. 9 illustrates in front view the embodiment of FIGS. 8*a*-8*c*.

FIG. 9 illustrates a front view of the padlock 81 with its combination locking assembly in a 'normal mode', i.e. not in a combination setting mode. The padlock 81 may, in the illustrated configuration (i.e. with its first and second housing parts 82, 83 immediately adjacent to one another and aligned with one another), be visually indistinguishable from the padlock 11 of FIGS. 1-7.

FIG. 10 illustrates in side view the padlock 81 with its combination locking assembly in an unlocked configuration and in a combination setting mode. The male screw thread 92 is visible on the cylindrical shaft 91 between the first housing part 82 and the second housing part 83. Being able to see the male screw thread part 92 may help a user of the padlock 81 remember or determine which direction second housing part 83 must be rotated in relative to first housing part 82 to take the combination locking assembly out of combination setting mode.

Padlock 81, like padlock 11, may be provided with one or more internal stops which prevent the first and second housing parts 82, 83 rotating beyond a predetermined angle relative to one another. Additionally or alternatively, a feature of the male and/or female screw thread parts may prevent the screw thread parts from disengaging one another at one end of the helical path defined by the screw thread parts, i.e. it may prevent the housing parts 82, 83 from rotating beyond the end of the helical path defined by the screw thread parts. Alternatively or additionally, the padlock 81 might be provided with means for preventing the housing parts 82, 83 from moving too far apart if the housing parts 82, 83 do rotate beyond the end of the helical path.

Padlock 81 may be provided with any of the other features of padlock 11, such as protrusions, recesses and/or set indicators, for example. The padlock 81 might for instance feature biasing means to try to cause the second housing part 83 to return towards the first housing part 82. However, at least in some examples, the biasing means may not apply sufficient force to cause the second housing part 83 to rotate along the helical path back towards the first housing part 82. The frictional resistance provided by the parts of the screw thread mechanism may be sufficient to prevent the first and second housing parts 82, 83 from rotating relative to each other.

In padlock 11 and padlock 81, each dial 15 comprises a plurality of slots (not visible in the figures) formed on the dial's inside surface, each slot for receiving and engaging a radially extending fin (not visible in the figures) of a corresponding clutch. Each clutch is received around the spindle 27, and its corresponding dial is received around the clutch, the clutches being able to freely rotate around the spindle 27. The internal cavity of the first housing part 12, in which the clutches reside, is configured such that axial movement of each clutch is prevented (and therefore axial movement of the spindle 27 is also prevented) unless the fin of each clutch is aligned with a corresponding slot (not visible in the figures) within the internal cavity of the first housing part 12.

When the fins are aligned with their corresponding slots in the internal cavity of the first housing part 12, the clutches are able to be moved axially downwards relative to the first housing part 12, and therefore the spindle 27 is also able to be moved axially in a direction away from the first housing part 12.

The padlock 11, 81 is configured such that the fins are aligned with their corresponding slots when the dials 15 are aligned with the correct combination of characters to put the padlock 11, 81 into the unlocked configuration. When the dials 15 are aligned in this way, the user is able to move the second housing part 13 away from the first housing part 12, moving the spindle 27 in a direction away from the first housing part 12, thus moving the clutch fins out of engagement with their corresponding dials 15, allowing the user to change the combination of characters which unlocks the combination locking assembly.

Some (though not necessarily all) padlocks as previously described may be provided with a key-operated locking assembly. The key-operated locking assembly may enable a user of the padlock equipped with an appropriate key to open the padlock without knowing the combination for the padlock and without setting a new combination for the padlock. The key-operated locking assembly may operate independently of the combination locking assembly, and/or may override the combination locking assembly so that the combination locking assembly unlocks when the key-operated locking assembly is actuated with an appropriate key. The key may be inserted into the key-operated locking assembly through an aperture in second housing part 13, 83, for example (such as the aperture illustrated in FIG. 3*b*).

Although the padlocks illustrated in the Figures include first and second housing parts which are approximately cuboid in shape, other shapes of padlock housing parts are possible. The housing parts may, for instance, be prisms of any shape, such as approximately circular, triangular, pentagonal, hexagonal, etc. The housing parts may be tapered and/or may change shape along one of their lengths.

Although the illustrated first and second housing parts correspond with one another in shape and sizing and have corresponding exterior surfaces, in other embodiments the first housing part may be different in size, shape and exterior surface from the second housing part. In some embodiments the housing parts may not correspond to one another or be similar.

Although in some examples movement of a second housing part has been described as towards or away from a first housing part, a skilled person appreciates that this is equivalent to the first housing part moving towards or away from the second housing part in a different reference frame, and to the two housing parts moving towards each other or away from each other in a third reference frame. Thus movement of the first and second housing parts should be considered to be relative movement of the parts away from or towards each other.

A padlock as described above may be said to be in combination setting mode when the combination locking assembly of that padlock is in combination setting mode. A combination locking assembly may also be referred to as a combination setting assembly.

The invention claimed is:

1. A combination padlock comprising:

a combination locking assembly operable between a locked configuration and an unlocked configuration;

a first housing part which is an upper housing part; and a second housing part connected to the first housing part, the second housing part being a lower housing part, the second housing part being movable relative to the first housing part when the locking assembly is in the unlocked configuration, the second housing part having an upper surface facing towards the first housing part, wherein the padlock is configured such that the combination locking assembly is caused to enter a combination setting mode by movement of the second housing part axially away from the first housing part and the padlock is configured such that rotation of the second housing part relative to the first housing part exposes at least part of the upper surface of the second housing part and maintains the second housing part at its axial displacement from the first housing part, whereby the combination locking assembly is maintained in combination setting mode.

2. A combination padlock as claimed in claim 1, wherein the padlock includes at least one stop configured to prevent the second housing part from rotating beyond a predetermined angle relative to the first housing part.

3. A combination padlock as claimed in claim 1, wherein the padlock comprises biasing means configured to bias the second housing part towards the first housing part.

4. A combination padlock as claimed in claim 3, wherein the biasing means includes at least one spring.

5. A combination padlock as claimed in claim 1, wherein the padlock includes a helical screw thread mechanism.

6. A combination padlock as claimed in claim 1, wherein one of the first housing part and the second housing part includes a male screw thread part and the other of the first housing part and the second housing part includes a female screw thread part.

7. A combination padlock as claimed in claim 6, wherein the male screw thread part and the female screw thread part are configured to engage one another.

8. A combination padlock as claimed in claim 6, wherein the second housing part is arranged to move away from the first housing part when the second housing part rotates in one direction along the screw thread parts and to move towards the first housing part when the second housing part rotates in the opposite direction along the screw thread parts.

9. A combination padlock as claimed in claim 6, wherein the first housing part includes the male screw thread part and the second housing part includes the female screw thread part.

10. A combination padlock as claimed in claim 1, wherein the padlock includes at least one recess in at least one of the first and second housing parts and includes at least one corresponding protrusion on at least the other of the first and second housing parts, said at least one recess and said at least one corresponding protrusion being engageable with one another.

11. A combination padlock as claimed in claim 10, wherein the combination locking assembly is operable between the combination setting mode and a normal mode, wherein said at least one protrusion engages with said at least one corresponding recess in the other of the housing parts when the padlock is in normal mode.

12. A combination padlock as claimed in claim 10, wherein said at least one recess and said at least one corresponding protrusion are complementary in shape.

13. A combination padlock as claimed in claim 10, wherein the protrusion protrudes from an edge of the first housing part or the second housing part.

14. A combination padlock as claimed in claim 13, wherein the protrusion and the exterior surface form a substantially continuous surface.

15. A combination padlock as claimed in claim 13, wherein the protrusion creates a stepped profile to the edge of the first housing part or the second housing part.

16. A combination padlock as claimed in claim 10, wherein the protrusion protrudes from a surface of the first housing part or the second housing part.

17. A combination padlock as claimed in claim 16, wherein the protrusion protrudes in a direction substantially orthogonal to the plane of the surface.

18. A combination padlock as claimed in claim 1, wherein the first housing part has an exterior surface and the second housing part has an exterior surface, and wherein the first and second housing parts are sized and shaped such that when the combination locking assembly is not in the combination setting mode the exterior surfaces of the first and second housing parts form a substantially continuous surface.

19. A combination padlock as claimed in claim 1, wherein the first housing part has a lower surface facing towards the second housing part and the second housing part has a corresponding upper surface facing towards the first housing part, the padlock having an equilibrium configuration in which the upper surface of the second housing part is flush with the lower surface of the first housing part, the second housing part being rotatably connected to the first housing part, and wherein, when the combination locking assembly is in the combination setting mode, the second housing part having been rotated relative to the first housing part, at least part of the upper surface of the second housing part is exposed.

20. A combination padlock as claimed in claim 1, further including a key-operated locking assembly.

* * * * *